US006135347A

United States Patent [19]

Mueller

[11] Patent Number: 6,135,347

[45] **Date of Patent: *Oct. 24, 2000**

[54] TRANSPORTABLE CONTAINER WITH PRESS CLOSURE

[76] Inventor: Charles J. Mueller, 140 W. Kohler St., Sun Prairie, Wis. 53590

[ * ] Notice: This patent is subject to a terminal disclaimer.

[21] Appl. No.: 09/276,064

[22] Filed: Mar. 25, 1999

Related U.S. Application Data

[63] Continuation-in-part of application No. 08/936,329, Sep. 24, 1997, Pat. No. 5,887,782.

[51] Int. Cl.[7] ..... B65D 5/00

[52] U.S. Cl. ..... 229/183; 229/117; 229/117.16; 229/142; 229/155; 229/149; 229/118; 40/313; 206/459.5; 206/232

[58] Field of Search ..... 229/117.13, 183, 229/117.15, 117, 117.16, 118, 117.17, 142, 143, 155, 149; 40/312, 313; 206/459.5, 232

[56] References Cited

U.S. PATENT DOCUMENTS

| | | | |
|---|---|---|---|
| 564,593 | 7/1896 | Craw . | |
| 641,500 | 1/1900 | Davidson . | |
| 732,071 | 6/1903 | Hartrampf . | |
| 783,089 | 2/1905 | Wildmann . | |
| 1,339,334 | 5/1920 | Heiser . | |
| 1,375,489 | 4/1921 | Davis . | |
| 1,926,365 | 9/1933 | Bergstein . | |
| 2,018,171 | 10/1935 | Himes . | |
| 2,122,654 | 7/1938 | Nickerson . | |
| 2,323,782 | 7/1943 | Kretchmer | 229/143 |
| 2,324,905 | 7/1943 | Chambliss . | |
| 2,348,070 | 5/1944 | Inman . | |
| 2,348,378 | 5/1944 | Goddyear . | |
| 2,418,963 | 4/1947 | Anderson, Jr. . | |
| 2,472,698 | 6/1949 | Edtmiller . | |
| 2,727,675 | 12/1955 | Mairs et al. | 229/143 X |
| 2,757,849 | 8/1956 | Duff, Jr. | 229/117.16 X |
| 3,055,569 | 9/1962 | Layne, Sr. . | |
| 3,058,585 | 10/1962 | Budd . | |
| 3,286,907 | 11/1966 | Crane . | |
| 3,301,461 | 1/1967 | Kroeschell . | |
| 3,366,496 | 1/1968 | Boman et al. . | |
| 3,477,633 | 11/1969 | Greene et al. . | |
| 3,550,837 | 12/1970 | Erb . | |
| 3,667,666 | 6/1972 | Pryor . | |
| 3,809,310 | 5/1974 | VanderLugt, Jr. | 229/155 |
| 4,148,429 | 4/1979 | Burr et al. | 229/143 |
| 4,236,740 | 12/1980 | Sorenson et al. | 229/143 X |
| 4,239,148 | 12/1980 | Sorenson et al. | 229/143 X |
| 4,676,428 | 6/1987 | McClure | 229/117.17 X |
| 5,125,567 | 6/1992 | McClure | 229/117.17 |
| 5,289,970 | 3/1994 | McClure | 229/143 |
| 5,295,632 | 3/1994 | Zink et al. . | |
| 5,394,982 | 3/1995 | Sawaya . | |
| 5,429,264 | 7/1995 | Hollander et al. | 229/143 X |
| 5,887,782 | 3/1999 | Mueller | 229/183 |

OTHER PUBLICATIONS

Exhibit A. Photograph of Ikon Document Services storage container having black squares of hook and loop fastener. Photographs of Mueller Matic® container on sale prior to Mar. 25, 1998.

*Primary Examiner*—Stephen P. Garbe
*Assistant Examiner*—Tri Mai
*Attorney, Agent, or Firm*—Lathrop & Clark, LLP

[57] ABSTRACT

A corrugated paperboard box has two opposed side panels, connected by two opposed end panels having oblong hand hold holes. The box has an automatic bottom for rapid assembly. Overlapping side top flaps extend from the side panels, and engage with one another to temporarily retain the side top flaps closed on the container. A closure flap extends from each side top flap to overlie portions of the other side top flap and the adjacent side panel. An oblong closure tab extends from a fold line from each closure flap and may be pressed through the hand hold hole to lock the side top flap in the closed condition. Each closure flap has two diagonal fold lines, and is larger than the hand hole into which it extends, such that, once fully inserted, the closure tabs are not readily extracted, thereby retaining the container in a securely closed condition without a requirement for tape, glue, or staples.

13 Claims, 4 Drawing Sheets

TRANSPORTABLE CONTAINER WITH PRESS CLOSURE

STATEMENT AS TO RIGHTS TO INVENTIONS MADE UNDER FEDERALLY SPONSORED RESEARCH AND DEVELOPMENT

CROSS REFERENCES TO RELATED APPLICATIONS

This application is a continuation-in-part of application Ser. No. 08/936,329, filed Sep. 24, 1997, issuing as U.S. Pat. No. 5,887,782 on Mar. 30, 1999, the disclosure of which is incorporated by reference herein.

BACKGROUND OF THE INVENTION

The present invention relates to containers with closures in general, and to containers formed from sheet material having press closures in particular.

One of the most economical and versatile containers is the corrugated paperboard box formed from die cut, scored, glued, and folded corrugated sheet stock. The corrugated box is lightweight for its strength, economically produced, compact in its collapsed condition, and ultimately recyclable.

Corrugated containers for producers may be assembled with the aid of automated equipment, tape dispensers, and adhesives. In many applications, however, a corrugated container must be assembled in the field, one at a time, as the need dictates. For consumer applications where the assembly environment is unpredictable, it is preferable that the box be capable of assembly without the need for tools or external adhesive materials.

In my U.S. Pat. No. 5,887,782, I disclosed a corrugated container having an automatic bottom and a two-part hook and loop fastener arrangement which permitted a rapid, convenient, and repeatable opening and closing of a box.

In certain applications, however, such as airline passenger freight transportation, and home moving, it would be desirable to have a low-cost paperboard container capable of carrying sizable cargos with a secure closure.

SUMMARY OF THE INVENTION

The corrugated box of this invention has two opposed side panels, connected by two opposed end panels having oblong hand holes. The box has an automatic bottom for rapid assembly. Overlapping side top flaps extend from the side panels, and engage with one another to temporarily retain the side top flaps closed on the container. A closure flap extends from each side top flap to overlie portions of the other side top flap and the adjacent side panel. An oblong closure tab extends along a fold line from each closure flap and may be pressed through the hand hole to lock the side top flaps in the closed condition. Each closure flap has two diagonal fold lines, and is larger than the hand hold hole into which it extends, such that, once fully inserted, the closure tabs are not readily extracted, thereby retaining the container in a securely closed condition without a requirement for tape, glue, or staples.

It is an object of the present invention to provide a corrugated paperboard container having a press closure which can be actuated without tools.

It is another object of the present invention to provide a corrugated paperboard container which optimizes usage of paperboard within a blank.

It is a further object of the present invention to provide a corrugated paperboard container with a reclosable closure which is conveniently assembled in an automated fashion.

It is also an object of the present invention to provide a container formed from precut and glued sheet material which is readily erected and enclosed about a transportable cargo.

It is also an object of the present invention to provide a container which may serve as a closed transport container, and, after transport be reused as a reclosable container.

It is another object of the present invention to provide a rapid assembly corrugated paperboard container with a smooth bottom and secure closure for ready transport on airport conveyor systems.

It is another object of the present invention to provide a corrugated paperboard box with a closure which contributes to the strength of the box in the hand hold region.

Further objects, features and advantages of the invention will be apparent from the following detailed description when taken in conjunction with the accompanying drawings.

DESCRIPTION OF THE PREFERRED EMBODIMENTS

Figure 1:
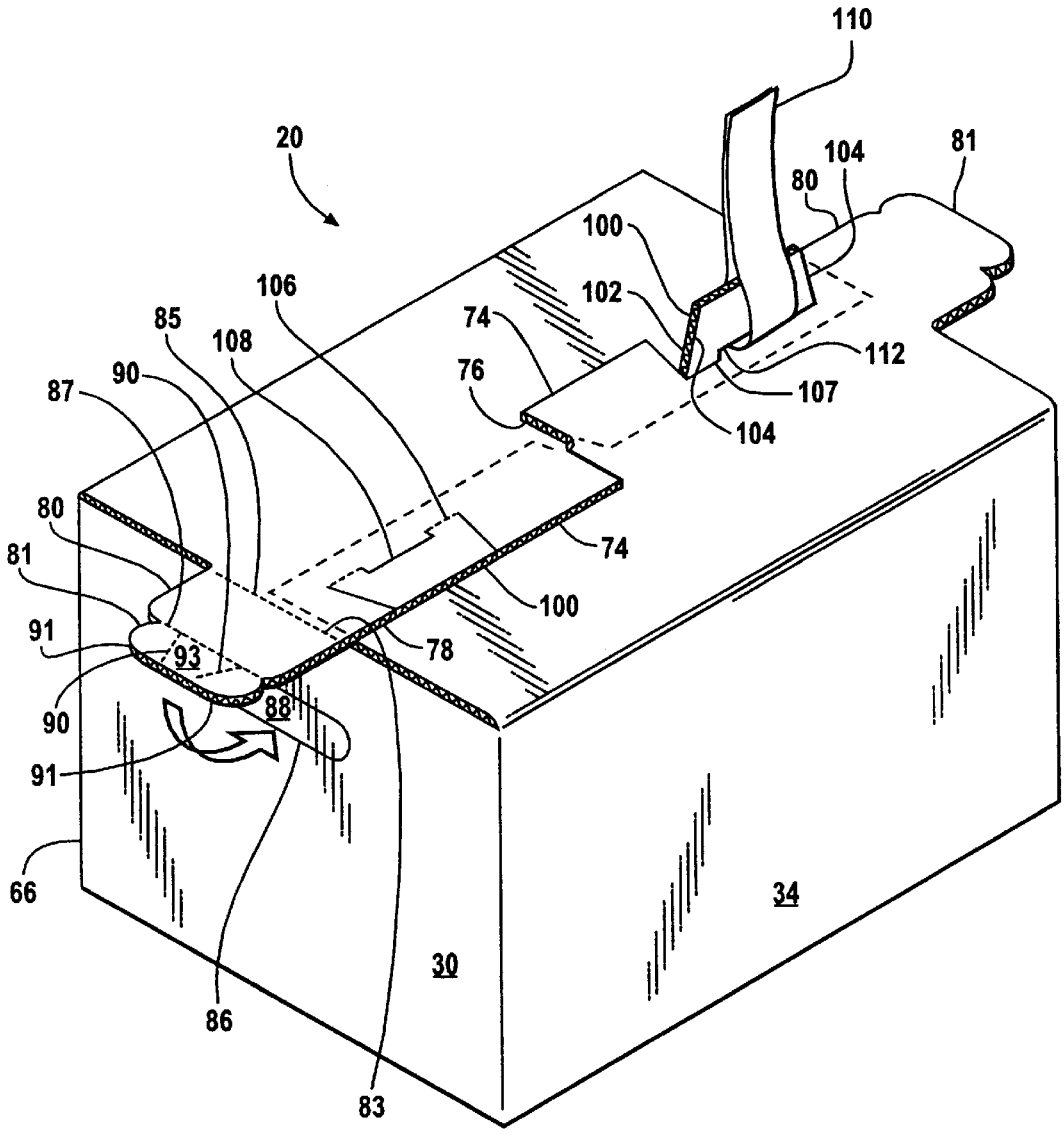
FIG. 1 is an isometric view of the box of this invention with the closure tabs shown in an unclosed configuration.

Referring more particularly to FIGS. 1–5, wherein like numbers refer to similar parts, a corrugated paperboard box 20 of this invention with a mechanical closure is shown in FIG. 1. The box 20 is formed in a knocked-down condition at the factory from a single corrugated paperboard blank 22, shown in FIG. 4. The blank 22 is cut, folded, and adhesively connected such that the knocked-down article is readily expandable into a box with minimal effort by the end user and without the need for connectors or adhesives in the final box assembly.

The blank 22 is a single thickness of conventional corrugated paperboard, having one, two, or more plies of corrugations, depending on the ultimate strength required. The blank 22 is die-cut and folded to minimize waste or un-utilized segments of corrugated paperboard. The box 20 is preferably generally rectangular, and therefore the blank 22 has a rectangular first side panel 28, with a first end panel 30 extending along a fold line on one side of the first side panel, and a second end panel 32 extending along a fold line on the other side. A second side panel 34, of dimensions similar to the first side panel 28, extends along a fold line from the second end panel 32. A glue flap 36 extends from the second side panel 34 along a fold line. The glue flap 36 is adhesively connected to the interior of the second end panel 32. It should be noted that the glue flap may alternatively be connected to the exterior of the second end panel 32. The side panels and the end panels form the vertically extending side walls of the assembled box 20.

Although the box 20 may be provided with any conventional bottom assembly, in a preferred embodiment user convenience is enhanced by providing an automatic bottom assembly which is readily and rapidly erected. An automatic bottom panel 38 extends from the first side panel 28 along a bottom fold line 40. The automatic bottom panel 38 is generally rectangular with a width approximately equal to the horizontal width of the side panels, and a length approximately equal to the horizontal width of the side panels. The automatic bottom panel 38 has an outer edge 42 which is spaced parallel from the bottom fold line 40. A first reverse-scored diagonal fold line 44 extends from the bottom fold line 40 to the outer edge 42. The first reverse fold line 44 extends at about 45 degrees from the bottom panel fold line 40. A second reverse-scored diagonal fold line 45 extends from the bottom panel fold line 40 to the outer edge 42. The first fold line 44 converges toward the second fold line 45. When the box 20 has side panels which are less than twice the width of the end panels, the first fold line and the second fold line will meet along the outer edge 42. For boxes of different dimensions, the two fold lines may terminate at different positions along the outer edge.

A first generally rectangular end flap 46 extends from the automatic bottom panel 38 along a first end flap fold line 48. A first angle is defined between the first end flap fold line 48 and the first fold line 44.

A second rectangular end flap 56 extends from the automatic bottom panel 38 along a second end flap fold line 58. A rectangular attachment region 50, indicated in FIG. 4 by a stippling pattern, is defined on the exterior face of the second end flap 56. In manufacture of the box 20, adhesive is applied to the attachment region 50 and the second end flap 56 is glued to the second end panel 32 to form a multi-ply end wall.

In order for the automatic bottom panel 38 to be free to collapse, the first end flap 46 cannot be fully connected to the first end panel 30. The first end flap 46 is therefore formed with a diagonal fold line 60 which extends at a 45 degree angle from the bottom edge of the flap along the first end flap from a point adjacent the intersection of the second reverse-scored fold line 45 and the bottom fold line 40. The diagonal fold line 60 thus divides the first end flap 46 into an upper portion 62 which is adhesively connected to the first end panel 30, and a lower portion 64 below the diagonal fold line which is not connected to the first end panel. Adhesive is applied to the exterior face of the upper portion 62 of the second end flap 56 and brought into contact with the first end panel to connect the first end flap to the first end panel and create a multi-ply end wall 66. The end flaps 46, 56, extend the full depth of the box to better contribute to the stacking strength of the box.

The automatic bottom panel, fixed to one end panel, and fixed along a diagonal fold line to the other panel, may thus be extended between a collapsed position alongside and substantially parallel to the side and end panels, and an assembled position substantially perpendicular to the side and end panels. The transformation of the finished blank from a compact, flat, corrugated assembly, into a dimensional storage box is effected by displacing the first side panel with respect to the second side panel, by, for example, gripping the flat assembly at the corners and applying pressure towards the interior of the assembly. This manipulation causes the article to expand into a box.

An interior bottom panel 68 extends along a fold line from the second side panel 34. The interior bottom panel 68 has approximately the same dimensions as the automatic bottom panel 38, and, in the knocked-down position, lies adjacent and between the folded side panels 28, 34. After the box 20 has been expanded so that the automatic bottom panel 38 forms the horizontal bottom of the box, the interior bottom panel 68 is pivoted downwardly to overlie the automatic bottom panel and there defines a flat, uncreased bottom to the box. To facilitate collapsing of the box 20 subsequent to assembly, the interior bottom panel may be provided with a finger opening cut-out 70 along its perimeter to permit a user to reach beneath the interior bottom panel, and fold it back along the second side panel 34.

Figure 2:
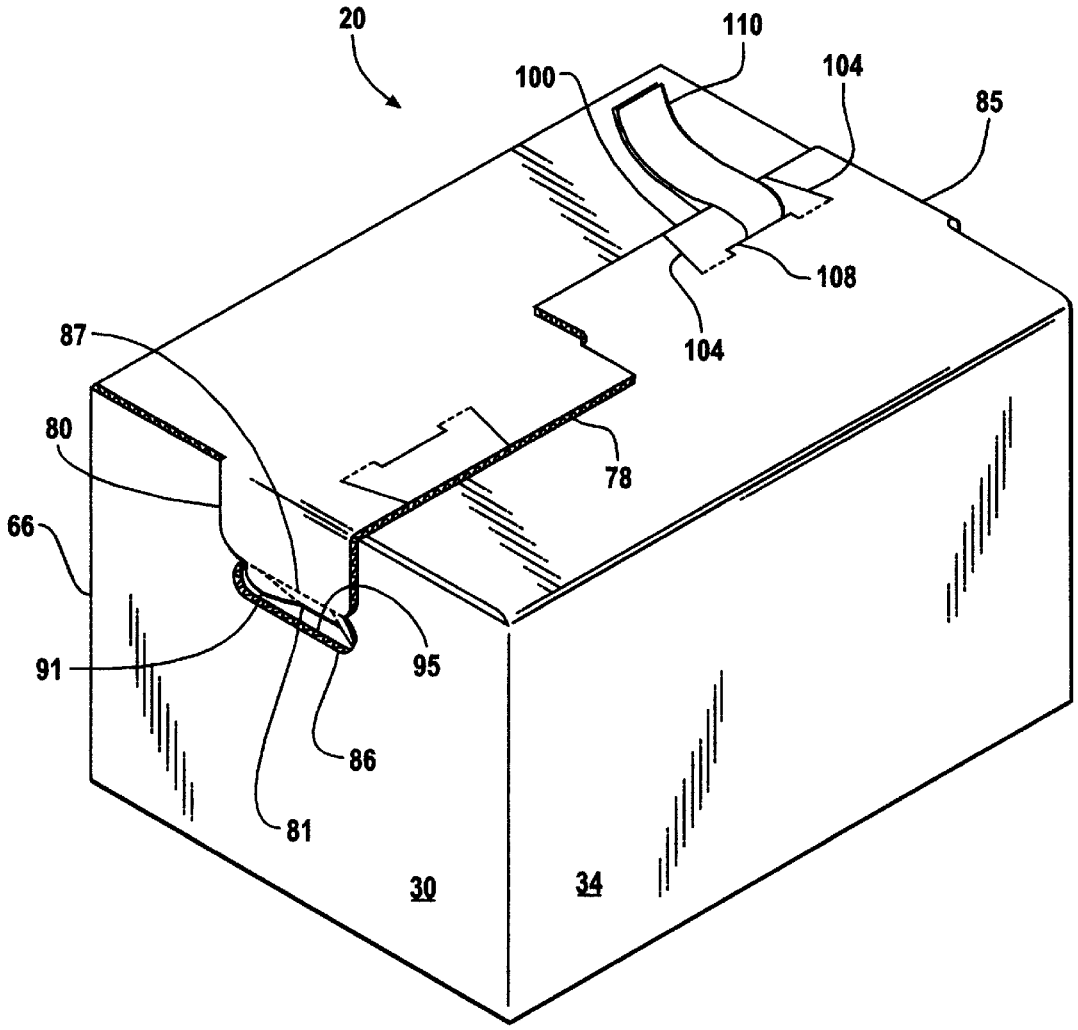
FIG. 2 is an isometric view of the box of FIG. 1 in a closed configuration.
Figure 3:
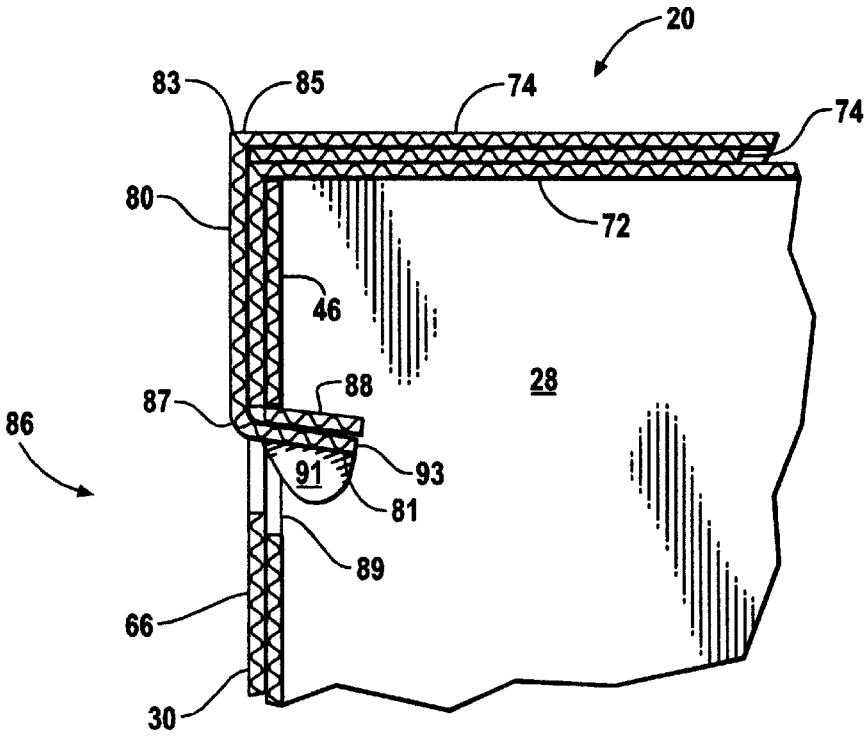
FIG. 3 is an enlarged fragmentary cross-sectional view of the box of FIG. 2 taken along section line 3—3.

The box 20 has a convenient closure to seal the box and protect the contents for storage, and more particularly for transport, as, for example, in moving, or in shipment of passenger luggage or cargo aboard an airplane. As shown in FIGS. 1–3, an end top flap 72 extends upwardly from each end panel 30, 32. A side top flap 74 extends upwardly from each side panel 28, 34. The side top flaps 74 are preferably provided with a diverging wall slot or cut-away 76 centered along the outer perimeter 78 of the flap. As shown in FIG. 1, the width of the side top flaps 74 is greater than one-half the width of the box 20. Thus, when the side top flaps 74 are folded down, the cut-aways 76 engage so that portions of the side top flaps 74 overlap, hold both side top flaps down over the box opening, where the box closure is readily engaged.

The box 20 has hand holds 86 for convenient lifting and transporting of the box. A hand hold 86 is defined in each end wall 66, by aligned oblong hinged hand hold tabs 88 in the end panels 30, 32 and oblong cut-outs 89 in the end flaps 46, 56. The hand hold tabs 88 define hand hole openings 95 when pushed inwardly. Because the hand holds 86 are formed in double thicknesses of corrugated paperboard, the box is better able to support the loads imposed by lifting at the hand holds. The box has a mechanical closure defined by die-cut and folded segments which cooperate with the hand holds 86 to form a secure but temporary one-time closure for the box 20.

Figure 4:
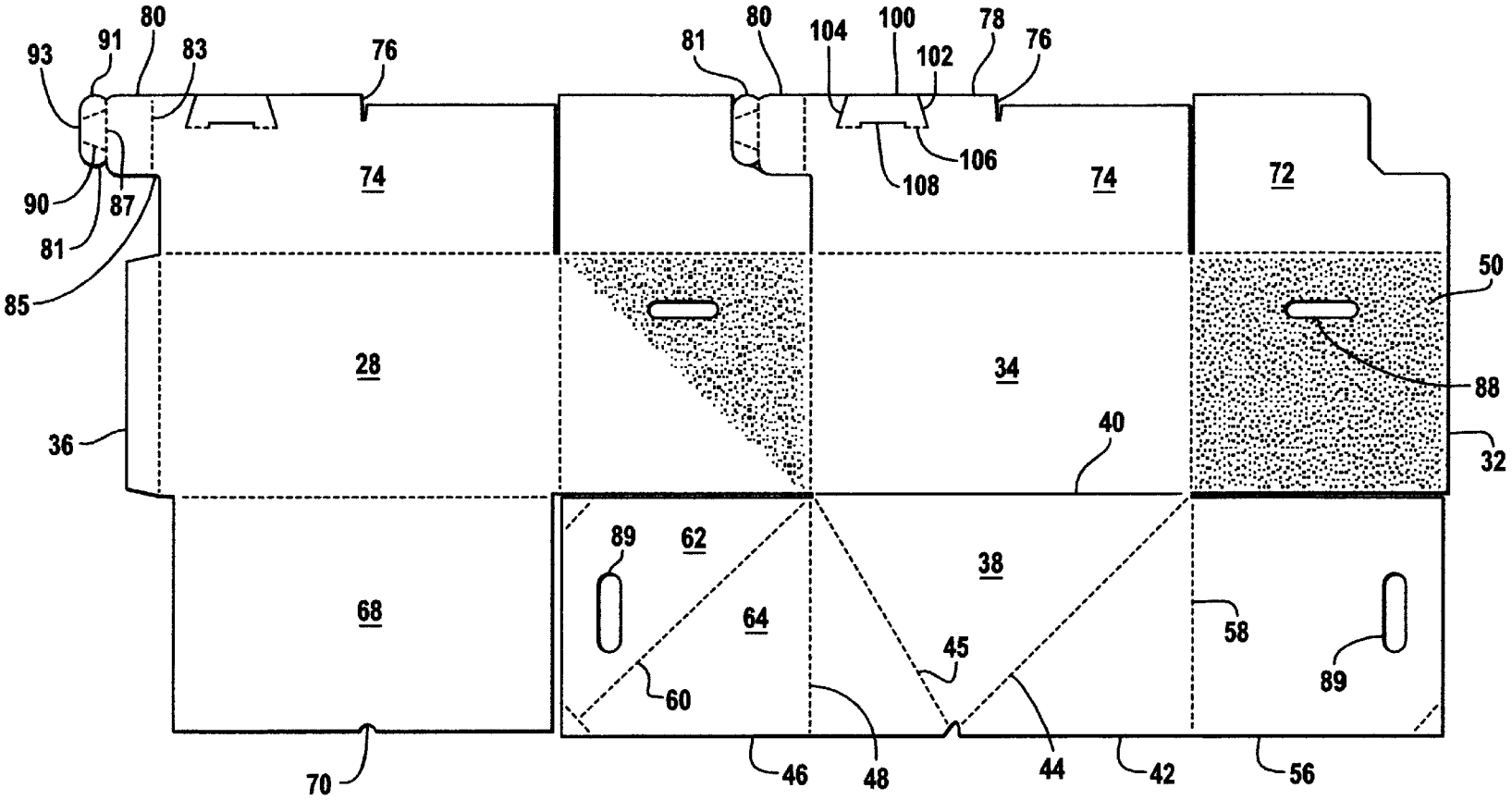
FIG. 4 is an inside plan view of the blank which may be assembled into the box of FIG. 1.

As shown in FIG. 1, each side top flap 74 has a sidewardly extending closure flap 80 with an attached closure tab 81. The material for the closure flaps 80 and closure tabs 81, as shown in FIG. 4, is economically provided by cutting the end top flaps 72 with cut-aways. As shown in FIG. 1, a closure flap 80 extends outwardly from each side top flap 74. Each closure flap 80 pivots downwardly along a fold line 83 which extends from the side top flap 74 on a stub 85 which protrudes from the end edge of the side top flap. Hence, when the closure flap 80 is folded downwardly, it is positioned to extend adjacent the box end wall 66. Each closure flap 80 is generally rectangular, and is long enough to position the closure tab 81 over the hand hold tab 88. The closure tab extends from the closure flap 80 along a fold line 87.

Each closure tab 81 has two reverse score lines 90 which extend downwardly from the fold line 87 and which converge toward one another as they extend away from the fold line 87. The reverse score lines 90 define two wings 91 on either side of the body 93 of the closure tab 81. The closure tab 81 is larger than the hand hold tabs 88, and hence, when the closure tab is pressed into the hand hold opening 95, the two wings 91 pivot outwardly on the reverse score lines 90, permitting entry of the closure tab 81, but restraining the escape of the closure tab from the hand hold opening.

When both closure tabs 81 are engaged within the hand hold openings 95, as shown in FIG. 2, the closure flaps 80 are held alongside the end panels 30, 32, and the side top flaps 74 are held in a closed configuration. The side top flaps 74 cannot be opened until the closure tabs 81 are extracted from the hand hold openings 95. The closure flaps and tabs thus provide a single use closure to the box 20 which does not require any adhesive tape or external fastener. In addition, because the material which forms the closure flaps and closure tabs comes from the end top flaps or material which would be waste in box manufacture, the added functionality is provided at no additional cost.

As shown in FIGS. 1 and 2, the side top flaps 74 interleave, such that the portions of one side top flap on the end of the side top flap between the slot 76 and the closure flap 80 overlaps the portion of the other side top flap between the slot and the end without a closure flap. If the side top flaps 74 are overlapped incorrectly, so the portions of the side top flaps without a closure flap are on top, the box may still be closed, but the top of the container will not be as flat, and a length of the side top flap perimeter edge 78 will be exposed. To reduce the possibility that a user will overlap the side top flaps 74 incorrectly, the perimeter 78 on the portion of the side top flap 74 which is to be covered, does not project as far as the portion of the side top flap 74 which is to do the covering, as shown in FIG. 4. This arrangement, although not making it impossible to incorrectly close the box, will make it much easier for the untrained assembler to close the box correctly. When the box 20 is provided with the tag restraint segments 100, it is particularly important that the side top flaps 74 be correctly closed, for if they are not overlapped properly, the tag restraint segments 100 will be inaccessible.

The closure flaps 80 and tabs 81, because they are positioned adjacent the hand holds 86, also contribute to the durability of the hand holds when they are used to lift and transport the loaded box 20. As shown in FIG. 3, five layers of corrugated material come together where a hand extends into the hand hold 86.

As shown in FIGS. 1 and 2, where the box 20 is used as an airline shipping container, it may be provided with tag restraint segments 100 which are die cut from the side top flaps 74. Each tag restraint segment 100 has an ear 102 with a base 107 which extends along a fold line 106 which is interrupted by a U-shaped die cut line 108. The ear 102 has sides 104 which converge as they approach the edge of the side top flap 74. To mark the container 20 with a baggage tag 110, a traveler grips the ear 102 and folds it upwardly along the fold line 106. When folded upwardly, as shown in FIG. 1, the U-shaped die cut line 108 defines an instantly available slot 112 beneath the ear 102, through which the baggage tag 110 can be looped. The ear 102 is then pressed back down into the same plane as the side top flap 74, as shown in FIG. 2. Because of the converging sides of the ear 102, the surrounding material of the side top flap 74 engages the sides 104 of the ear, and restrains tearing of the ear 102 if any tugging forces are applied in the plane of the side top flap 74.

Figure 5:
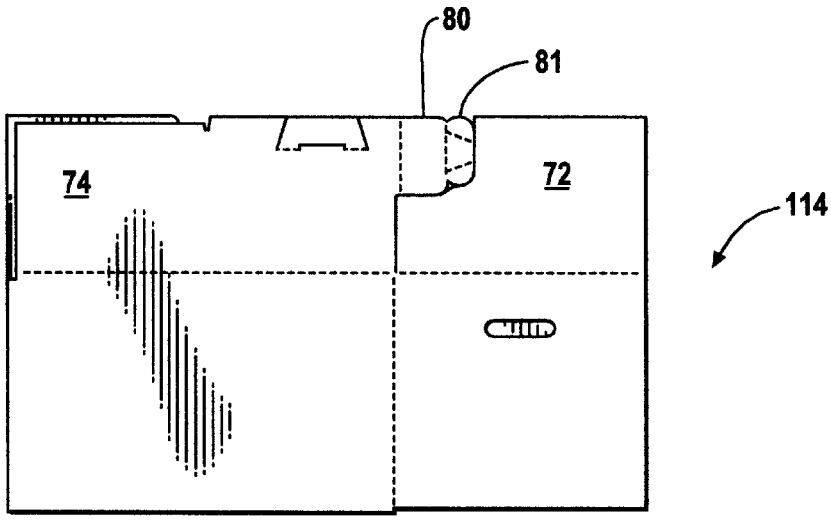
FIG. 5 is a top plan view of the box of FIG. 1 in a collapsed configuration.

As shown in FIG. 5, since the closure flaps 80 and closure tabs 81 extend sidewardly within the blank 22, rather than upwardly, they do not protrude from the glued up and collapsed article 114, thereby facilitating manufacture.

After the initial use of the box 20 with the closure flaps and tabs to secure the top flaps in a closed condition, the closure flaps and tabs may be cut or torn off, and the box may be used as a reclosable storage container.

It is understood that the invention is not limited to the particular construction and arrangement of parts herein illustrated and described, but embraces such modified forms thereof as come within the scope of the following claims.

I claim:

1. A box comprising:

a first side wall;

a first end wall extending adjacent the first side wall;

portions of the first end wall defining a first hand hold hole having a height and a width;

a second side wall extending adjacent the first end wall;

a second end wall extending between the first side wall and the second side wall;

portions of the second end wall defining a second hand hold hole having a height and a width;

a first side top flap extending alone an upper edge of the first side wall;

a first closure flap extending outwardly from the first side top flap, the first closure flap being positioned to extend adjacent the first end wall;

a first closure tab extending from the first closure flap and pivotable about the first closure flap to extend into the first hand hold hole and thereby retain the first closure flap engaged with the first end wall;

a second side top flap extending along an upper edge of the second side wall, the second side top flap having portions which extend beneath the first side top flap when the box is in a closed configuration;

a second closure flap extending outwardly from the second side top flap, the second closure flap being positioned to extend adjacent the second end wall;

a second closure tab extending from the second closure flap and pivotable about the second closure tab to extend into the second hand hold hole and thereby retain the second closure flap engaged with the second end wall; and a tag restraint ear which is die cut from a side top flap, the side top flap having an inner edge, and the ear having a base which extends along an ear fold line which is interrupted by a generally U-shaped die cut line, the ear extending from the ear fold line to the side top flap inner edge, and wherein upward pivoting of the ear about the ear fold line reveals a baggage tag slot at the U-shaped die cut line through which a baggage tag may be inserted.

2. The container of claim 1 wherein the ear has sides which converge as they approach the inner edge of the side top flap on which the ear is formed, and wherein when the ear is pressed down into the same plane as the side top flap, the surrounding material of the side top flap engages the sides of the ear and restrains tearing of the ear if any tugging forces are applied in the plane of the side top flap.

3. A box comprising:

a first side wall;

a first end wall extending adjacent the first side wall;

portions of the first end wall defining a first hand hold hole having a height and a width;

a second side wall extending adjacent the first end wall;

a second end wall extending between the first side wall and the second side wall;

portions of the second end wall defining a second hand hold hole having a height and a width;

a first side top flap extending along an upper edge of the first side wall;

a first closure flap extending outwardly from the first side top flap, the first closure flap being positioned to extend adjacent the first end wall;

a first closure tab extending from the first closure flap and pivotable about the first closure flap to extend into the first hand hold hole and thereby retain the first closure flap engaged with the first end wall;

a second side top flap extending along an upper edge of the second side wall, the second side top flap having portions which extend beneath the first side top flap when the box is in a closed configuration;

a second closure flap extending outwardly from the second side top flap, the second closure flap being positioned to extend adjacent the second end wall; and a second closure tab extending from the second closure flap and pivotable about the second closure tab to extend into the second hand hold hole and thereby retain the second closure flap engaged with the second end wall, wherein each side top flap extends from a side panel along a side fold line, and wherein portions of each side top flap define a perimeter edge which extends on either side of a slot, and wherein the distance between the side fold line and the perimeter edge is greater on the end of the side top flap between the closure tab and the slot, than on the end of the side top flap between the slot and the end not having a closure tab.

4. A container comprising:

a corrugated paperboard box having two opposed side panels, connected by two opposed end panels, with at least one panel defining a box bottom, wherein each end panel has portions which defines a hand hold hole;

a side top flap extending from each of the two side panels, the side top flaps being pivotable about the side panels from which they extend such that portions of the side top flaps overlap one another to close the box;

a closure flap extending from each of the side top flaps, each closure flap being pivotable with respect to the side top flap from which it extends to overlie an adjacent end panel in the closed box; and a closure tab extending from each closure flap along a fold line, the closure tab being receivable within the hand hold hole, and having portions which extend through the hand hold hole into the interior of the box to restrain the escape of the closure tab from the hand hold hole, and to thereby retain the side top flaps closed on the box, wherein each side top flap has portions defining a cut-out, such that the cut-outs of the two side top flaps engage when the assembled box is closed, and wherein each side top flap has a first end and a second end, each first end having a closure flap, and each second end being without a closure flap, and wherein the side top flaps comprise a first side top flap and a second side top flap, the side top flaps being interleavable such that portions of the first side top flap on the first end between the slot and the closure flap overlaps portions of the second side top flap between the slot and second side top flap second end without a closure flap.

5. The container of claim 4 wherein each side top flap extends from a side panel along a side fold line, and wherein portions of each side top flap define a perimeter edge which extends on either side of the slot, and wherein the distance between the side fold line and the perimeter edge is greater on the end of the side top flap between the closure tab and the slot, than on the end of the side top flap between the slot and the end not having a closure tab.

6. A corrugated paperboard blank for assembly into a box with a mechanical closure, the blank comprising:

a first side wall;

a first end wall extending along a fold line adjacent the first side wall, the first end wall having an upper edge;

portions of the first end wall defining a first hand hold hole spaced a first distance below the end wall upper edge;

a second side wall extending along a fold line adjacent the first end wall;

a second end wall extending along a fold line from the second side wall, the second end wall having an upper edge;

portions of the second end wall defining a second hand hold hole spaced the a second distance below the second end wall upper edge;

a first side top flap extending along a first side fold line from an upper edge of the first side wall, the first side top flap having a perimeter edge spaced from the first side fold line, wherein portions of the first side top flap define a slot which extends from the perimeter edge toward the first side fold line;

a first closure flap extending outwardly from the first side top flap along a first closure fold line approximately parallel to the fold line between the first side panel and the first end panel;

a first closure tab extending from the first closure flap along a second closure fold line, the distance between the first closure fold line and the second closure fold line being approximately the first distance, such that in an assembled box the first closure tab is positionable to extend into the first hand hold hole;

a second side top flap extending along a second side fold line from an upper edge of the second side wall, the second side top flap having a perimeter edge spaced from the second side fold line, wherein portions of the second side top flap define a slot which extends from the perimeter edge toward the second side fold line;

a second closure flap extending outwardly from the second side top flap along a second closure fold line approximately parallel to the fold line between the second side panel and the second end panel; and a second closure tab extending from the second closure flap along a second closure fold line, the distance between the second closure fold line and the second closure fold line being approximately the second distance, such that in an assembled box the second closure tab is positionable to extend into the second hand hold hole.

7. The blank of claim 6 wherein each closure flap has two reverse score lines which extend from the second closure fold line and which converge to divide each closure flap into a body with two sidewardly extending wings.

8. The blank of claim 6 wherein portions of each side top flap define a perimeter edge which extends on either side of the slot, and wherein the distance between the side fold line and the perimeter edge is greater on the end of the side top flap between the closure tab and the slot, than on the end of the side top flap between the slot and the end not having a closure tab.

9. The blank of claim 6 further comprising an automatic bottom panel which extends from a side panel, the automatic bottom panel having two end flaps extending therefrom, wherein portions of each end flap are adhesively connectable to an adjacent end panel, and wherein the automatic bottom panel has two angled fold lines formed therein such that the blank may be readily assembled into a box.

10. The blank of claim 6 further comprising a tag restraint ear which is die cut from one of the first and second side top flaps, the ear having a base which extends along an ear fold line which is interrupted by a generally U-shaped die cut line, the ear extending from the ear fold line to the side top flap perimeter edge, and wherein upward pivoting of the ear about the ear fold line reveals a baggage tag slot at the U-shaped die cut line through which a baggage tag may be inserted.

11. The blank of claim 10 wherein the ear has two sides which converge as they approach the perimeter edge of the side top flap on which the ear is formed, and wherein when the ear is pressed down into the same plane as the side top flap, the surrounding material of the side top flap engages the sides of the ear and restrains tearing of the ear if any tugging forces are applied to the ear in the plane of the side top flap.

12. A container comprising:

a corrugated paperboard box having two opposed side panels, connected by two opposed end panels, with at least one panel defining a box bottom, wherein each end panel has portions which defines a hand hold hole;

a side top flap extending from each of the two side panels, the side top flaps being pivotable about the side panels from which they extend such that portions of the side top flaps overlap one another to close the box;

a closure flap extending from each of the side top flaps, each closure flap being pivotable with respect to the side top flap from which it extends to overlie an adjacent end panel in the closed box; and a closure tab extending from each closure flap alone a fold line, the closure tab being receivable within the hand hold hole, and having portions which extend through the hand hold hole into the interior of the box to restrain the escape of the closure tab from the hand hold hole, and to thereby retain the side top flaps closed on the box, wherein each side top flap has portions defining a cut-out, such that the cut-outs of the two side top flaps engage when the assembled box is closed; and a tag restraint ear which is die cut from a side top flap, the side top flap having an inner edge, and the ear having a base which extends along an ear fold line which is interrupted by a generally U-shaped die cut line, the ear extending from the ear fold line to the side top flap inner edge, and wherein upward pivoting of the ear about the ear fold line reveals a baggage tag slot at the U-shaped die cut line through which a baggage tag may be inserted.

13. The container of claim 12 wherein the ear has two sides which converge as they approach the inner edge of the side top flap on which the ear is formed, and wherein when the ear is pressed down into the same plane as the side top flap, the surrounding material of the side top flap engages the sides of the ear and restrains tearing of the ear if any tugging forces are applied to the ear in the plane of the side top flap.

* * * * *